US008523524B2

(12) United States Patent
Benson et al.

(10) Patent No.: US 8,523,524 B2
(45) Date of Patent: Sep. 3, 2013

(54) AIRFOIL COOLING HOLE FLAG REGION

(75) Inventors: Adebukola Benson, Greenville, SC (US); Gary Michael Itzel, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 659 days.

(21) Appl. No.: 12/731,783

(22) Filed: Mar. 25, 2010

(65) Prior Publication Data

US 2011/0236220 A1 Sep. 29, 2011

(51) Int. Cl.
*F01D 5/18* (2006.01)

(52) U.S. Cl.
USPC ..... 416/92; 416/97 R

(58) Field of Classification Search
USPC ..... 415/115; 416/92, 95, 96 R, 97 R
See application file for complete search history.

(56) References Cited

U.S. PATENT DOCUMENTS

| | | | | |
|---|---|---|---|---|
| 5,536,143 | A * | 7/1996 | Jacala et al. | 416/96 R |
| 5,690,472 | A * | 11/1997 | Lee | 416/97 R |
| 6,142,734 | A * | 11/2000 | Lee | 416/97 R |
| 7,114,916 | B2 * | 10/2006 | Dube et al. | 415/115 |
| 7,270,515 | B2 | 9/2007 | Liang | |
| 2003/0068222 | A1 * | 4/2003 | Cunha et al. | 415/115 |
| 2003/0086785 | A1 * | 5/2003 | Bunker et al. | 415/115 |
| 2007/0041835 | A1 | 2/2007 | Charbonneau et al. | |
| 2008/0226461 | A1 * | 9/2008 | Beeck et al. | 416/90 R |
| 2008/0239669 | A1 | 10/2008 | Wayman | |
| 2009/0023025 | A1 | 1/2009 | Korsgaard | |
| 2011/0236620 | A1 * | 9/2011 | Duffy | 428/92 |
| 2012/0171047 | A1 * | 7/2012 | Itzel et al. | 416/97 R |

FOREIGN PATENT DOCUMENTS

WO WO 2008055737 A1 * 5/2008

OTHER PUBLICATIONS

Machine translation of WO 2008/055737 A1 from Espacenet.*
Machine translation of WO 2008/055737 A1 (published May 15, 2008) from Espacenet.*

* cited by examiner

*Primary Examiner* — Edward Look
*Assistant Examiner* — Christopher R Legendre
(74) *Attorney, Agent, or Firm* — Cantor Colburn LLP

(57) ABSTRACT

An airfoil is provided and includes a body formed to define a substantially radially extending cooling hole therein, which is configured to be receptive of a supply of a coolant for removing heat from the body, and a flag region therein, which is fluidly communicative with the cooling hole and thereby configured to be receptive of a portion of the supply of the coolant such that the coolant portion is directed to form a vortex within the flag region to increase heat removal from the body beyond that provided by the coolant flow through the cooling hole.

24 Claims, 2 Drawing Sheets

AIRFOIL COOLING HOLE FLAG REGION

BACKGROUND OF THE INVENTION

The subject matter disclosed herein relates to an airfoil having a cooling hole with a flag region.

In turbine engines, such as gas turbine engines or steam turbine engines, fluids at relatively high temperatures contact blades that are configured to extract mechanical energy from the fluids to thereby facilitate a production of power and/or electricity. While this process may be highly efficient for a given period, over an extended time, the high temperature fluids tend to cause damage that can degrade performance and increase operating costs.

Accordingly, it is often necessary and advisable to cool the blades to at least prevent or delay premature failures. This can be accomplished by delivering relatively cool compressed air to the blades. In many traditional gas turbines, in particular, this compressed air enters the bottom of each of the blades and flows through one or more round machined passages in the radial direction to cool the blade through a combination of convection and conduction.

In these traditional gas turbines, as the temperature of the fluids increase, it becomes necessary to increase the amount of cooling flow through the blades. This increased flow can be accomplished by an increase in a size of the cooling holes. However, as the cooling holes increase in size, the wall thickness of each hole to the external surface of the blade decreases and eventually reaches a minimum wall thickness required to maintain manufacturability and structural integrity of the blade.

BRIEF DESCRIPTION OF THE INVENTION

According to one aspect of the invention, an airfoil is provided and includes a body formed to define a substantially radially extending cooling hole therein, which is configured to be receptive of a supply of a coolant for removing heat from the body, and a flag region therein, which is fluidly communicative with the cooling hole and thereby configured to be receptive of a portion of the supply of the coolant such that the coolant portion is directed to form a vortex within the flag region to increase heat removal from the body beyond that provided by the coolant flow through the cooling hole.

According to another aspect of the invention, an airfoil of a turbine bucket is provided and includes a body having opposing pressure and suction surfaces extending axially between opposing leading and trailing edges and radially between inward and outward portions, the body being formed to define a substantially radially extending cooling hole therein, which is configured to be receptive of a supply of a coolant such that the coolant is forced to flow along a length thereof to remove heat from the body, and the body being further formed to define a flag region therein, which is fluidly communicative with the cooling hole and thereby configured to be receptive of a portion of the supply of the coolant such that the coolant portion is directed to form a vortex within the flag region to increase heat removal from the body beyond that provided by the coolant flow through the cooling hole.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
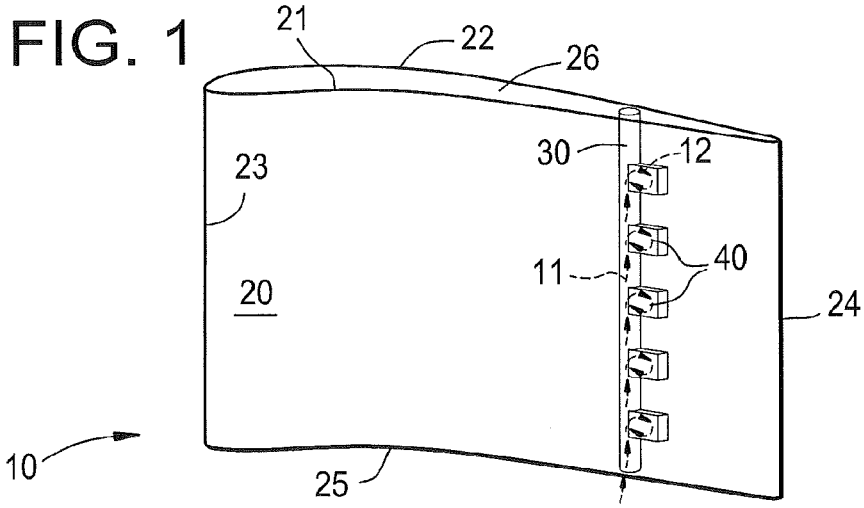
FIG. 1 is a perspective view of an airfoil.
Figure 2:
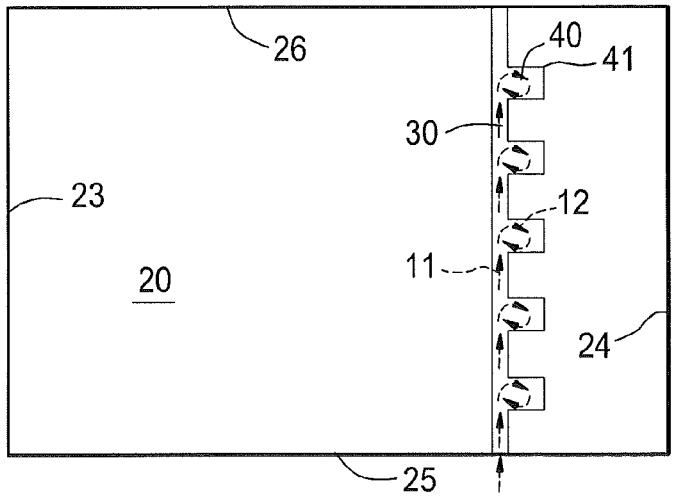
FIGS. 2 and 3 are perpendicular plan views of the airfoil of FIG. 1.
Figure 3:
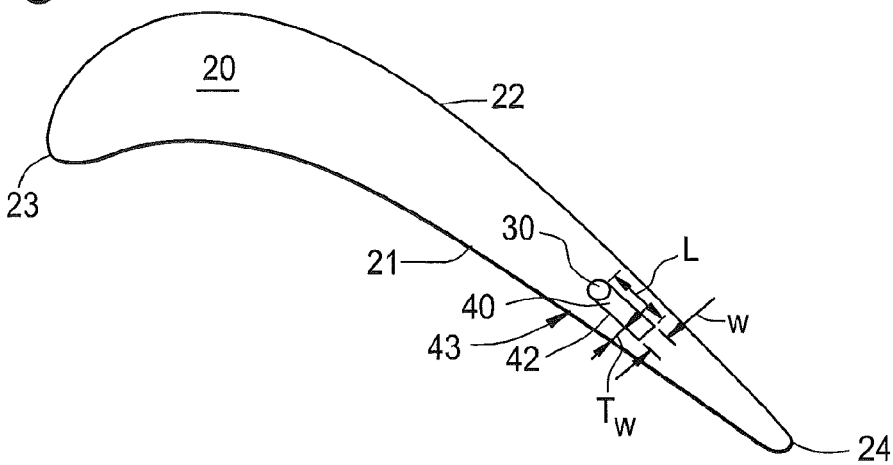

With reference to FIGS. 1-3, an airfoil 10 of a turbine bucket is provided. The airfoil 10 includes coolant 11 and a body 20 having opposing pressure and suction surfaces 21 and 22 extending axially between opposing leading and trailing edges 23 and 24 and radially between inward and outward portions 25 and 26.

The body 20 may be an airfoil blade body and is formed to define a substantially radially extending cooling hole 30 therein, which is configured to be receptive of a supply of a coolant 11 such that the coolant 11 is forced to flow along a length thereof to remove heat from the body 20. The cooling hole 30 may be of ovoid or round or non-ovoidal or non-round shapes such as, for example, elliptical, race track, rectangular etc. The body 20 is further formed to define a flag region 40 therein. The flag region 40 is fluidly communicative with the cooling hole 30 and thereby configured to be receptive of a portion of the supply of the coolant 11 such that the coolant 11 portion is directed to form a vortex 12 within the flag region 40. The vortex formation increases heat removal from the body 20 beyond that which is provided by the flow of the coolant 11 through the cooling hole 30.

A width, W, of the flag region 40 may be substantially similar to that of the cooling hole 30 in the circumferential direction. The flag region 40 may tangentially extend in an axial direction from a location of maximum circumferential width of the cooling hole 30. A corner 41 of the flag region 40 may be defined with a right angle and, in some cases, the flag region 40 may be formed to have a substantially rectangular or square cross-section in at least one of radial and axial directions.

Figure 4:
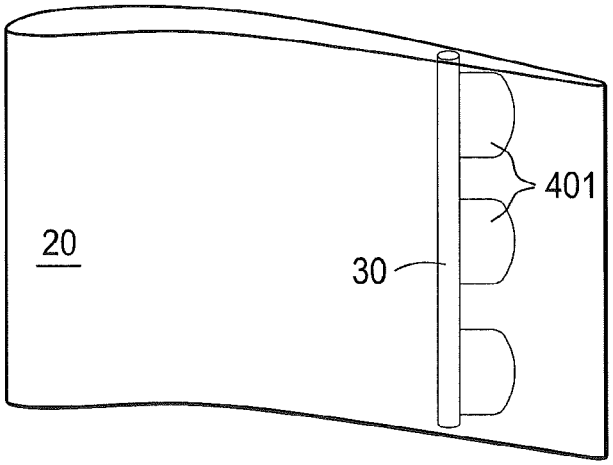
FIGS. 4 and 5 are perspective views of an airfoil according to further embodiments.
Figure 5:
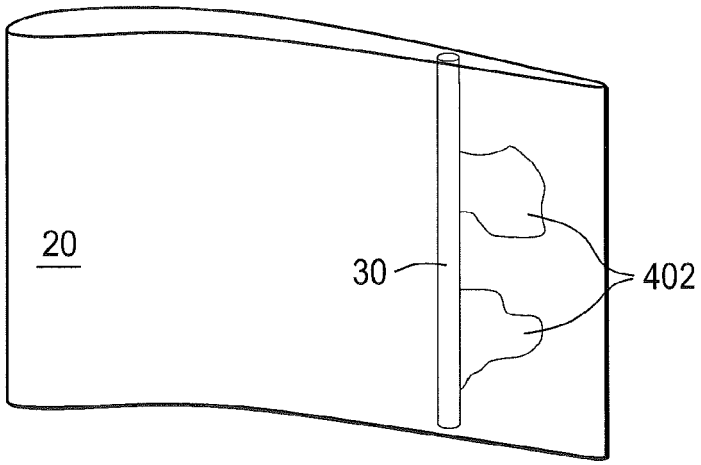

With reference to FIGS. 4 and 5, although the flag region 40 is described above as having a substantially rectangular shape, it is to be understood that this is merely exemplary and that other shapes and configurations are possible. For example, as shown in FIG. 4, the flag region 40 may, in some cases, have a non-rectangular shape 401 with edges at right or non-right angles, and which are rounded or non-rounded. Similarly, as shown in FIG. 5, the flag region 40 may also have a symmetrical shape or a non-symmetrical shape 402. In each case, as will be described below, the shapes and radial spacing between a flag region 40 and another flag region 40 may vary along the length of cooling hole 30.

The flag region 40 may be plural in number, as shown in FIG. 1. The plural flag regions 40 may be arrayed along the cooling hole 30 in a radial direction. In some embodiments, the plural flag regions 40 may be arrayed along an entire length of the cooling hole 30 in the radial direction. Conversely, the plural flag regions 40 may be arrayed along only a portion of the cooling hole 30 length.

The plural flag regions 40 may each have similar or, in some cases, differing shapes and may be aligned with or offset from one another. Where the flag regions 40 are offset, a degree of the offset is set to in accordance with a twist of the body 20. However, even where the flag regions 40 are offset from one another, they may still be aligned in at least one dimension. For example, as shown in FIG. 2, even if the body 20 is twisted in a manner not evident from FIG. 2, the flag regions 40 are aligned in the radial direction.

The plural flag regions 40 may also be radially discrete in that the flag regions 40 are aligned with one another in the radial direction and separated by areas of airfoil material. Here, the radially discrete plural flag regions 40 may be spaced from one another by either a uniform radial distance or a variable radial distance that is established based on a known heating profile of the airfoil 10.

As shown in FIG. 3, the flag regions 40 may be substantially equidistant from the pressure and suction surfaces 21 and 22 and closer to the trailing edge 24 than the leading edge 23 although this is not required. At least one sidewall 42 delimiting the flag region 40 may be substantially or nearly parallel with a local portion 43 of at least one of the pressure and suction surfaces 21 and 22. In any case, however, a wall thickness, $T_w$, between the flag region 40 and the pressure and suction surfaces 21 and 22 is at least a predefined minimum thickness. This predefined minimum thickness should be a minimum thickness that preserves the operability and manufacturability of the airfoil 10.

In accordance with further aspects of the invention, the airfoil 10 may be defined with multiple cooling holes 30 with each cooling hole 30 being associated with zero, one or more flag regions 40. For example, a series of cooling holes 30 may be arrayed axially along the camber line of the airfoil 10 with only the most downstream one or two cooling holes 30 having flag regions 40.

In accordance with still further aspects of the invention, the cooling holes 30 and the flag regions 40 may be formed within the airfoil 10 by machining processes, such as electro-chemical machining (ECM) or the like. In particular, a heating profile of the airfoil 10 may be determined through testing to illustrate where the airfoil 10 is most likely to be heated beyond safe levels. Then, the cooling holes 30 and the flag regions 40 can be machined in those regions to thereby maintain a lower temperature therein.

Additionally, if it is found that only a small portion of the airfoil tends to be heated beyond the safe levels, the machining of the cooling holes 30 and the flag regions 40 can be strictly limited to that small portion. As such, a structural impact of the cooling holes 30 and the flag regions 40, in terms of local areas of high stress, for example, can be substantially reduced.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An airfoil, comprising:

a body formed to define:

a substantially radially extending cooling hole therein, which is configured to be receptive of a supply of a coolant for removing heat from the body, and a flag region therein, which is fluidly communicative with the cooling hole and thereby configured to be receptive of a portion of the supply of the coolant such that the coolant portion is directed to form a vortex within the flag region to increase heat removal from the body beyond that provided by the coolant flow through the cooling hole, the flag region having a same width in a circumferential dimension as that of the cooling hole in the circumferential dimension and being open at one axial end to permit fluid communication with the cooling hole and closed at an opposing axial end to facilitate formation of the vortex within the flag region.

2. The airfoil according to claim 1, wherein a corner of the flag region is angular.

3. The airfoil according to claim 1, wherein the flag region has a substantially rectangular cross-section in radial and axial directions.

4. The airfoil according to claim 1, wherein the flag region has a substantially square cross-section in radial and axial directions.

5. The airfoil according to claim 1, wherein the flag region has a non-rectangular shape and at least one of one or more right angle edges, non-right angle edges and rounded edges.

6. The airfoil according to claim 1, wherein the flag region is one of symmetrical and non-symmetrical.

7. The airfoil according to claim 1, wherein the flag region extends from the cooling hole in an axial direction.

8. The airfoil according to claim 1, wherein the flag region is plural and arrayed along the cooling hole in a radial direction.

9. The airfoil according to claim 8, wherein the plural flag regions are arrayed along the cooling hole in the radial direction.

10. The airfoil according to claim 8, wherein the plural flag regions are arrayed along a portion of the cooling hole in the radial direction.

11. The airfoil according to claim 8, wherein the plural flag regions each have similar shapes.

12. The airfoil according to claim 8, wherein the plural flag regions are offset from one another.

13. The airfoil according to claim 12, wherein a degree of the offset is in accordance with a radial twist of the body.

14. The airfoil according to claim 8, wherein the plural flag regions are aligned with one another in at least one dimension.

15. The airfoil according to claim 8, wherein the plural flag regions are radially discrete.

16. The airfoil according to claim 15, wherein the radially discrete plural flag regions are spaced from one another by a uniform radial distance.

17. The airfoil according to claim 8, wherein the plural flag regions have shapes and radial spacing that vary along a length of the cooling hole.

18. The airfoil according to claim 1, wherein the cooling hole is elongate in a radial dimension and has an ovoid cross-section.

19. An airfoil of a turbine bucket, comprising:

a body having opposing pressure and suction surfaces extending axially between opposing leading and trailing edges and radially between inward and outward portions, the body being formed to define a substantially radially extending cooling hole therein, which is configured to be receptive of a supply of a coolant such that the coolant is forced to flow along a length thereof to remove heat from the body, and the body being further formed to define a flag region therein, which is fluidly communicative with the cooling hole and thereby configured to be receptive of a portion of the supply of the coolant such that the coolant portion is directed to form a vortex within the flag region to increase heat removal from the body beyond that provided by the coolant flow through the cooling hole, the flag region having a same width in a circumferential dimension as that of the cooling hole in the circumferential dimension and being open at one axial end to permit fluid communication with the cooling hole and closed at an opposing axial end to facilitate formation of the vortex within the flag region.

20. The airfoil according to claim 19, wherein the flag region is substantially equidistant from the pressure and suction surfaces.

21. The airfoil according to claim 19, wherein the flag region is closer to the trailing edge than the leading edge.

22. The airfoil according to claim 19, wherein at least one sidewall delimiting the flag region is substantially parallel with a local portion of at least one of the pressure and suction surfaces.

23. The airfoil according to claim 19, wherein a wall thickness between the flag region and the pressure and suction surfaces is at least a predefined minimum thickness.

24. The airfoil according to claim 19, wherein the body comprises an airfoil blade.

* * * * *